US005901877A

United States Patent [19]

Fujiu

[11] Patent Number: 5,901,877

[45] Date of Patent: May 11, 1999

[54] AUTOMATIC VENDING MACHINE

[75] Inventor: Minoru Fujiu, Isesaki, Japan

[73] Assignee: Sanden Corp., Isesaki, Japan

[21] Appl. No.: 08/899,339

[22] Filed: Jul. 23, 1997

[30] Foreign Application Priority Data

Sep. 6, 1996 [JP] Japan ..... 8-236887

[51] Int. Cl.[6] ..... A24F 27/14

[52] U.S. Cl. ..... 221/150 HC; 312/407

[58] Field of Search ..... 221/150 R, 150 HC, 221/150 A; 312/407, 406, 401, 403

[56] References Cited

FOREIGN PATENT DOCUMENTS 5-334542 4/1990 Japan .
5334542 4/1990 Japan .

*Primary Examiner*—Kenneth Noland
*Attorney, Agent, or Firm*—Kenjiro Hidaka

[57] ABSTRACT

An automatic vending machine has a housing containing a plurality of vertical commodity storage chamber sections in a side-by-side arrangement. A thermally-insulating divider panel is fixedly disposed between each pair of adjacent chamber sections in a manner that the adjacent chamber sections are communicated with each other through an air channel therebetween. A removable thermally-insulating divider panel is placed between a selected pair of adjacent chamber sections to block the air channel, thereby forming fist and second groups of chamber sections that are not communicated with each other. The first and the second chamber section groups can individually be refrigerated and heated, respectively. A top edge of the removable divider panel is adapted to abut a part of the corresponding fixed divider panel, and both the edges, when abutting to each other, are upwardly inclined toward the front of the vending machine so as to facilitate replacement of the removable divider panel. The vending machine has a front door that is adapted for holding and storing the removable divider panel in a slant position.

5 Claims, 5 Drawing Sheets

AUTOMATIC VENDING MACHINE

BACKGROUND OF THE INVENTION

1 . Field of the Invention

This invention relates to an automatic vending machine having a plurality of vertical commodity storage chamber sections arranged side by side and employing a refrigerating system and a heating system that can refrigerate and heat, respectively, two groups of the chamber sections separately.

2. Description of the Prior Art

Japanese patent publication, laid-open no. 5-334542 dated the chambers and the divider panel contains an insulating material, such as polyurethane foam, the size and the weight of the panel are substantial. The removing or placing of the divider panel from or into the vending machine, or the storing thereof, therefore, has been a troublesome task.

The same Japanese patent publication also discloses a storage space for the divider panel that is provided in a side end of the vending machine. This extra storage space for the divider panel inevitably occupies a side portion of the inside space of the vending machine, causing the vending machine to be made wider. A wider vending machine can not easily be substituted for a standard size vending machine when the width of the site is limited or when the standard size vending machine being replaced is flanked on both sides by other vending machines.

SUMMARY OF THE INVENTION

In view of the above situation, it is an object of the present invention to provide an automatic vending machine that is equipped with both a refrigerating system and a heating system and the commodity storage space thereof can be divided into a first chamber to be refrigerated and a second chamber to be heated by a removable thermally-insulating divider panel, and yet, the size of the removable panel is smaller and the weight thereof lighter as compared with that of a prior known removable thermally-insulating divider panel, so that removing, placing and storing of the divider panel is facilitated.

A further object of the present invention is that the removable divider panel can be removed from, or inserted into, the vending machine in a smooth friction-less manner.

An additional object of the present invention is to provide an automatic vending machine having a removable thermally-insulating divider panel, and yet, no extra side space of the vending machine is used up for storing the removable divider panel.

In order to achieve the above objects, an automatic vending machine according to the present invention has following features:

The vending machine has a housing, in an upper part of which is provided a commodity storage chamber and in a bottom part of which is provided a machinery compartment. A plurality of vertical chamber sections are provided, arranged laterally side-by-side, in the commodity storage chamber. Each chamber section, having a substantially equal width and a substantially equal internal volume, contains a plurality of serpentine-type commodity racks arranged in a column, one behind another. A vertical thermally-insulating divider panel, which is fixed to the housing, is disposed at each boundary between each pair of adjacent chamber sections in a manner that only a part of each boundary between adjacent chamber sections is permanently partitioned off by the fixed divider panel in an airtight fashion but the remaining part of the boundary is normally left unclosed so that adjacent chamber sections are normally communicated with each other through the unclosed part of the boundary. The vending machine is also provided with a removable thermally-insulating divider panel. The removable divider panel can be placed in the commodity storage chamber between a selected pair of adjacent chamber sections so as to completely shut off the unclosed part of the boundary between the selected adjacent chamber sections in an airtight fashion, so that the selected adjacent chamber sections can no longer communicate with each other.

The entire top edge of the removable divider panel is adapted to abut a part of the edge of any of the fixed divider panels when the removable divider panel is placed between a selected adjacent chamber sections, and both the top edge of the removable divider panel and the part of the edge of the corresponding fixed divider panel, abutting to each other, are upwardly inclined toward the front of the vending machine so that the removal and the insertion of the removable divider panel from and into the commodity chamber is facilitated.

By properly selecting a pair of adjacent chamber sections and placing the removable divider panel therebetween, the entire commodity storage chamber of the vending machine can be divided into two groups of chamber sections having a desired internal volume distribution therebetween. The first and the second groups of chamber sections are partitioned off and thermally insulated from each other by one of the fixed divider panels and the removable divider panel. The first group can be refrigerated by the refrigerating system while the second group can be heated by the heating system.

DETAILED DESCRIPTION OF THE PREFERRED EMBODIMENTS

The present invention will now be described in detail with reference to the drawings.

Figure 1:
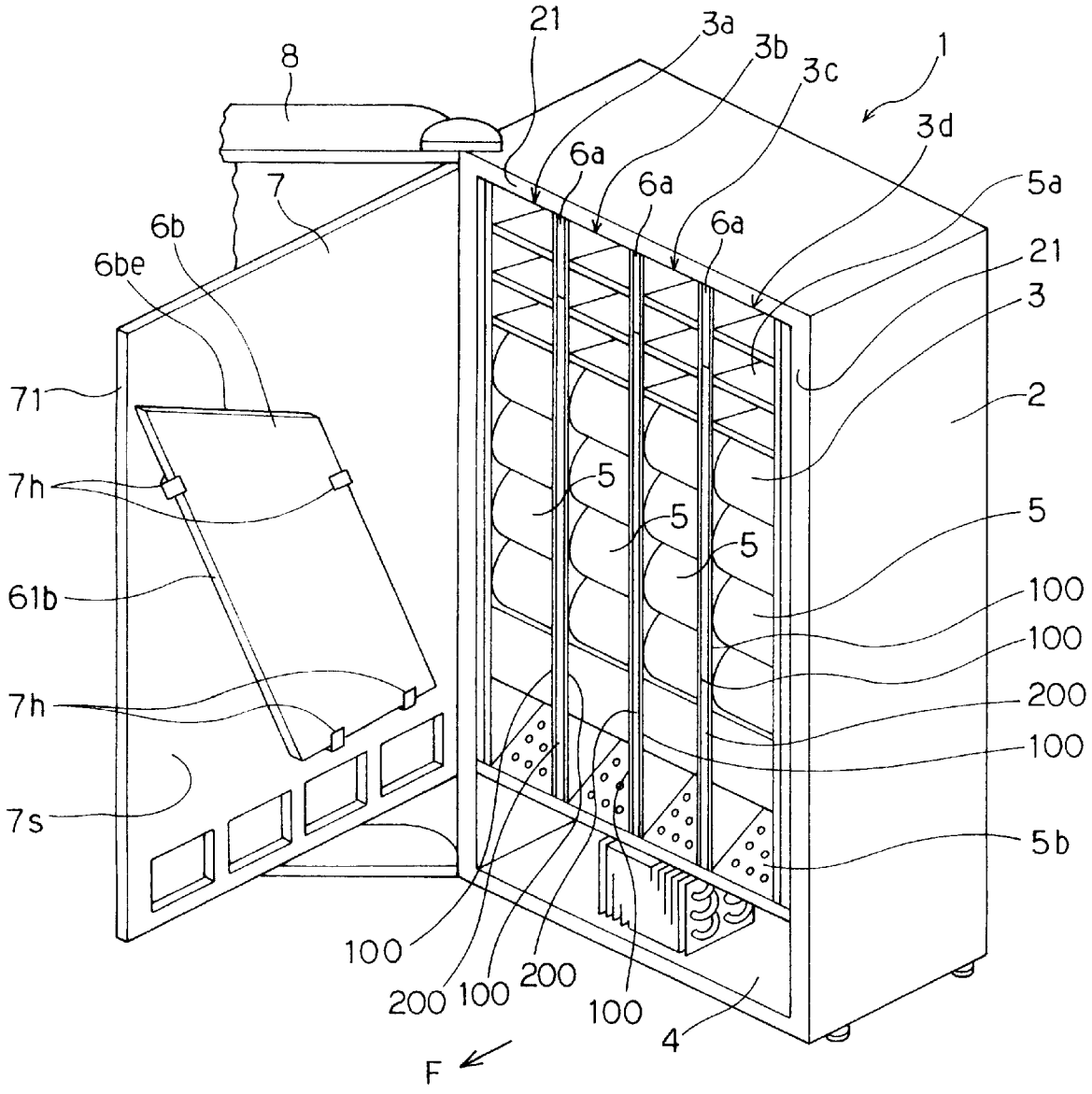
FIG. 1 is a perspective view of an automatic vending machine according to the present invention.
Figure 2:
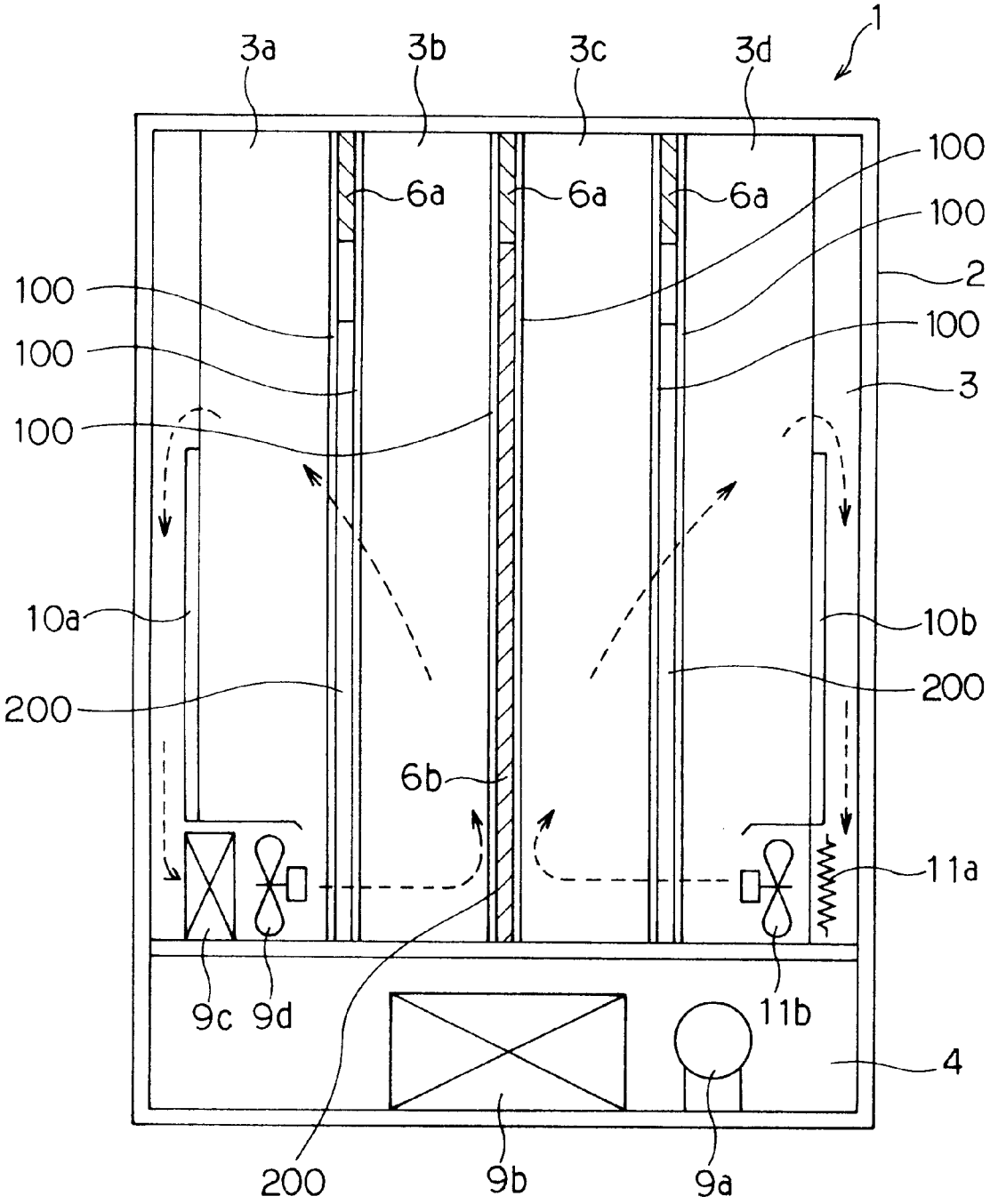
FIG. 2 is a front elevational sectional view showing some essential parts of the automatic vending machine shown in FIG. 1.

In reference to FIGS. 1 and 2, an automatic vending machine 1 has a housing 2 and, inside the housing 2, a thermally-insulated commodity storage chamber 3 in an upper part thereof and a machinery compartment 4 in a bottom part thereof. Character 'F' with an arrow signifies the front side of the vending machine 1.

The commodity storage chamber 3 is divided into a plurality of vertical commodity storage chamber sections 3*a*, 3*b*, 3*c* and 3*d* arranged laterally in a side-by-side fashion. Each of the chamber sections 3*a*–3*d* has substantially an even width and an even internal volume. Although four chamber sections 3*a*–3*d* are provided in this embodiment, the number of the chamber sections may be appropriately changed in alternative embodiments.

A set of serpentine-type commodity storage racks 5 are provided in each of the commodity storage chamber sections 3*a*, 3*b*, 3*c* and 3*d*. In this embodiment, three racks 5 are disposed per chamber section in a column arrangement, one behind another, whereby a total of twelve racks (three per column, four per row) are housed in the commodity chamber 3, though only the four racks 5 in the front row are shown in FIG. 1 and major parts of the racks 5 are not shown in FIG. 2. Reference numeral 5*a* in FIG. 1 denotes commodity inlet ports and reference numeral 5*b* denotes commodity outlet chutes. As already mentioned above, serpentine-type commodity storage racks are commonly used in prior known automatic vending machines.

As shown in FIG. 1, the vending machine 1 further has, on the front side (F) thereof, a thermally-insulating inside door 7, which heat-shields the commodity storage chamber 3 on the front side thereof, and an outside door 8. Both the inside door 7 and the outside door 8 are pivotably supported by the housing 2.

Figure 3A:
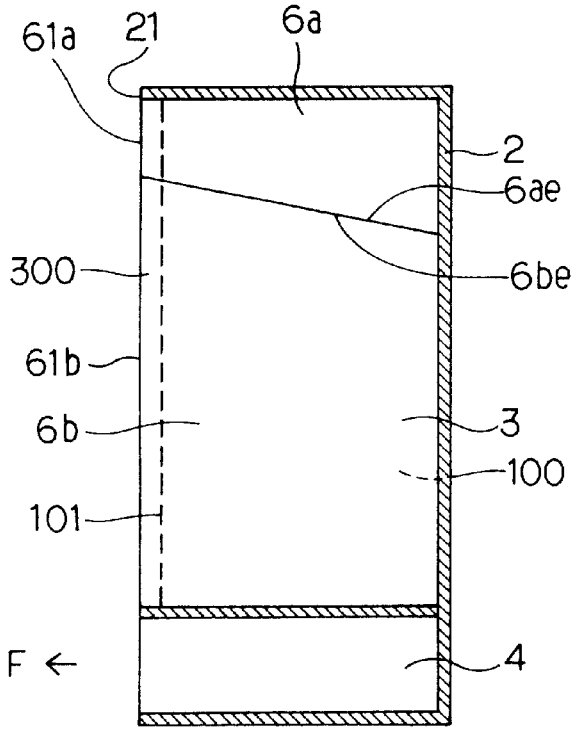
FIGS. 3(*a*) and 3(*b*) are side elevational sectional views particularly showing a housing, one of fixed upper divider panels, the removable lower divider panel and one of the guide plates used for the vending machine shown in FIG. 1 according to the first embodiment of the present invention.
Figure 3B:
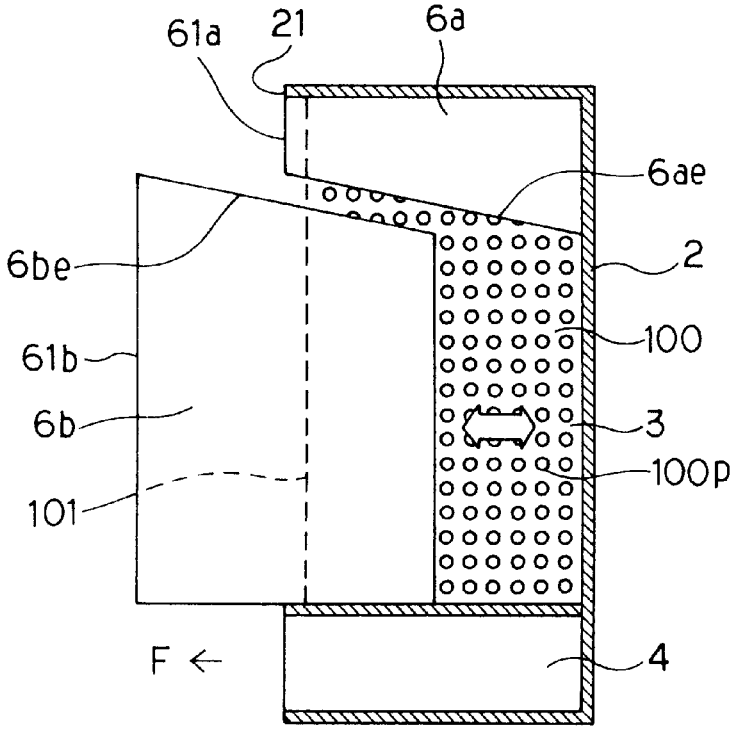

Referring to FIGS. 1, 2, 3(*a*) and 3(*b*), a plurality of vertical thermally-insulating upper divider panels 6*a*, all securely fixed to the housing 2, are provided in the commodity storage chamber 3 in a manner that each of the upper divider panels 6*a* is located at each boundary between each pair of adjacent chamber sections 3*a*–3*b*, 3*b*–3*c*, or 3*c*–3*d* and each of the upper divider panels 6*a* partitions off and closes only an upper part of the boundary completely in an airtight fashion but leaving the remaining part therebelow of the boundary unclosed so that each pair of the adjacent chamber sections 3*a*–3*b*, 3*b*–3*c*, or 3*c*–3*d* are normally communicated with each other through the unclosed part of the boundary.

The vending machine 1 further has a removable thermally-insulating lower divider panel 6*b*. The lower divider panel 6*b* can be removably and vertically placed immediately below, and in contact with, any of the fixed upper divider panels 6*a* between any selected pair of adjacent chamber sections 3*a*–3*b*, 3*b*–3*c*, or 3*c*–3*d* in a manner that the lower divider panel 6*b* completely shuts off the communication between the selected adjacent chamber sections.

Figure 1A:
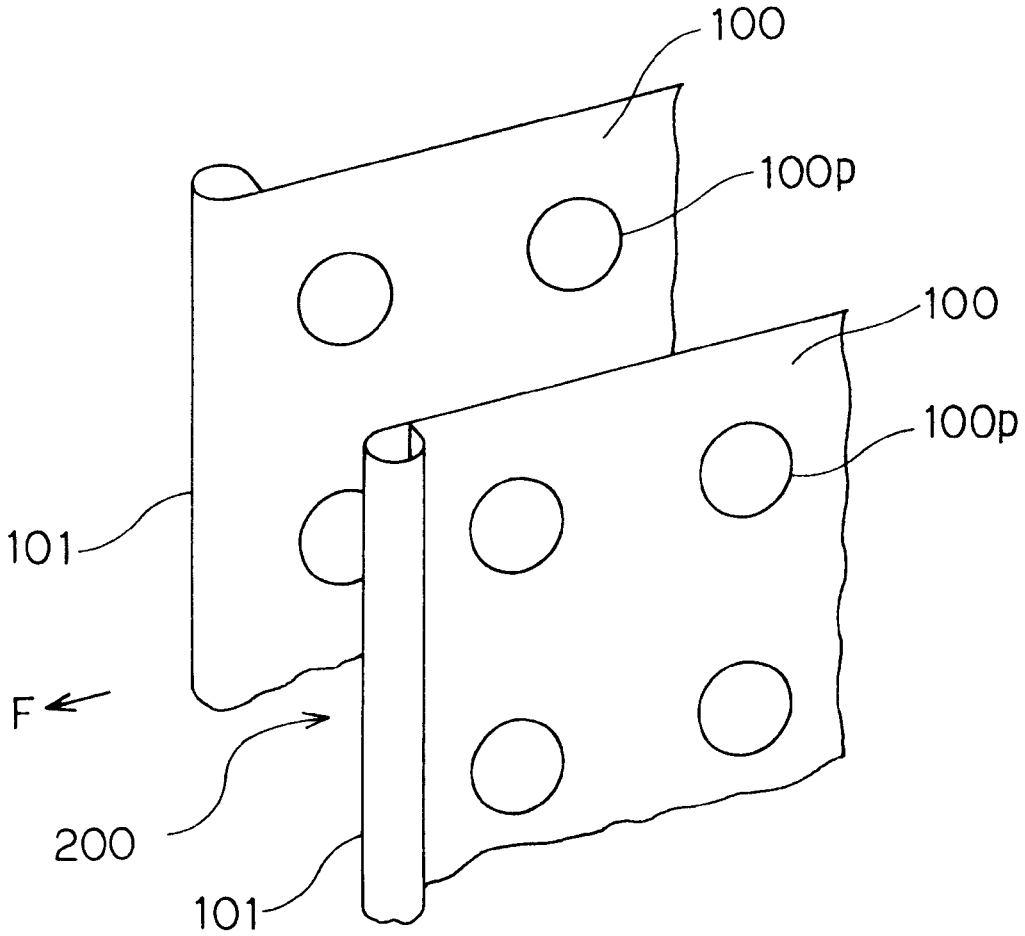
FIG. 1A is an enlarged partially cutout perspective view of a pair of guide plates for guiding a removable lower divider panel used for the vending machine shown in FIG. 1.

Referring to FIGS. 1, 1A, and 2, the vending machine 1 additionally has three pairs of vertical guide plates 100 in the commodity storage chamber 3 for guiding the removable lower divider panel 6*b* into the commodity storage chamber 3 between the selected pair of the adjacent chamber sections 3*a*–3*b*, 3*b*–3*c*, or 3*c*–3*d*. Each pair of guide plates 100 are fixedly disposed at each boundary between each adjacent chamber sections in parallel with, and opposing to, each other leaving a narrow guide space 200 therebetween. Each guide space 200 is for guiding and accepting the removable lower divider panel 6*b* thereinto, and the width of the guide space 200 is such that the lower divider panel 6*b* is snugly inserted between the guide plates 100. The guide plates 100 extend over the entire depth and the height of the commodity storage chamber 3 and each of the fixed upper divider panels 6*a* is sandwiched between a pair of the guide plates 100. In this embodiment, the side frames of the above mentioned serpentine-type commodity racks 5, which are made of sheet metal, are utilized as the guide plates 100. Each of the guide plates 100 has a plurality of perforations loop that constitute an air channel between the adjacent chamber sections 3*a*–3*b*, 3*b*–3*c*, or 3*c*–3*d*. When the lower divider panel 6*b* is inserted to the guide space 200 between the selected pair of chamber sections, all of the perforations loop, i.e. the air channel, of the corresponding pair of guide plates 100 are blocked by the lower divider panel 6*b*, so that the communication between the selected pair of the chamber sections is completely shut off. Referring particularly to FIG. 1A, each of the guide plates 100 has a front edge 101 that is curled in the direction away from the guide space 200 to facilitate insertion of the lower divider panel 6*b* thereto.

FIG. 2 shows the lower divider panel 6*b* being placed under the upper divider panel 6*a* that is located at the lateral center of the housing 2. Thus, the lower divider panel 6*b*, as shown in FIG. 2, partitions off the chamber section 3*b* from the chamber section 3*c*, thereby dividing the commodity storage chamber 3 into two groups of commodity chamber sections, the first group consisting of the chamber sections 3*a* and 3*b* and the second group consisting of the chamber sections 3*c* and 3*d*. Thus, the first and the second groups of the chamber sections are partitioned off and thermally-insulated from each other by the upper divider panel 6*a* and the lower diver panel 6*b* so that the communication between the two chamber groups is completely blocked and any heat conduction therebetween is deemed negligible.

FIG. 3(*a*) particularly shows the housing 2 in section, one of the fixed upper divider panels 6*a* and the removable lower divider panel 6*b* immediately below the corresponding fixed upper divider panel 6*a*. In FIG. 3(*a*), the rectangular area defined by the broken line and the perimeter lines of the commodity storage chamber 3 represent the area of the guide plates 100. FIG. 3(*b*) shows the lower divider panel 6*b* being removed halfway from the commodity storage chamber 3 and one of the guide plates 100 with the perforations 100*p* therein.

Referring to FIGS. 3(*a*) and 3(*b*), each of the upper divider panels 6*a* has a bottom end edge 6*ae* and the lower divider panel 6*b* has a top end edge 6*be*, the two end edges 6*ae* and 6*be* abut each other in substantially an air-tight fashion when the lower divider panel 6*b* is placed in the commodity storage chamber 3 between the selected chamber sections, and the bottom end edge 6*ae* of each of the upper divider panels 6*a* and the top end edge 6*be* of the lower divider panel 6*b* are upwardly inclined toward the front F of the vending machine 1 so that removal or insertion of the lower divider panel 6*b* is facilitated.

Referring back to FIG. 1, the inside door 7 has a set of holder 7*h* on an inside surface 7*s* thereof for holding and storing the lower divider panel 6*b* when the lower divider panel 6*b* is not used in the commodity storage chamber 3. Numeral 71 represents a vertical side edge of the inside door 7 and characters 61*b* represent a straight front edge of the removable lower divider panel 6*b*. The holder 7*h* is adapted for holding the lower divider panel 6*a* in a manner that the front edge 61*b* thereof is always at an angle with respect to the side edge 71 of the inside door 7 or with respect to an imaginary vertical line.

Referring to FIGS. 1, 3(*a*) and 3(*b*), reference numerals or characters 21 and 61*a* represent front edges of the housing 2 and front edges of the upper divider panels 6*a*, respectively. All of the front edges 21, 61*a* and 61*b* are aligned so as to be in an imaginary common vertical plane when the lower divider panel 6*b* is placed in position in the commodity storage chamber 3. As shown in FIG. 3(*a*), the front edges 101 of the guide plates 100 are recessed from the front edges 21 of the housing 2 to form a space 300 in a front section of the housing 2 having an enough depth for accommodating therein the lower divider panel 6*b* and the holder 7*h* when the lower divider panel 6*b* is held by the holder 7*h* on the inside door 7 for storage. When the lower divider panel 6*b* is in use in the commodity storage chamber 3 and the inside door 7 is closed, all of the front edges 21, 61*a* and 61*b* abut the inside surface 7*s* of the inside door 7 in an air-tight fashion, so that no air flow is permitted between the two groups of chamber sections partitioned off from each other by the lower divider panel 6*b*. The location of the holder 7*h* on the inside door 7 is determined such that the holder 7*h* does not interfere with any of the front edges 101 of the guide plates 100 when the inside door 7 is closed.

Referring again to FIG. 2, the automatic vending machine 1 has a refrigerating system and a heating system that can be operated independently from each other. The refrigerating system includes a compressor 9*a* and a condenser 9*b* , both of which are disposed in the machinery compartment 4, an evaporator 9*c* and an air drive fan 9*d*, both of which are disposed in a rear part and on the left side (as viewed in FIG. 2) of the commodity storage chamber 3, an expansion valve (not shown) and an air guiding duct 10*a*. As the air driven by the fan 9*d* circulates through the chamber sections 3*a*, 3*b* of the first group, the duct 10*a* and the evaporator 9*c*, as indicated by arrowed broken lines, the chamber sections 3*a*, 3*b* are cooled by the refrigerating system.

The heating system includes an electric heater 11*a* and an air drive fan 11*b*, both of which are disposed in a rear part and on the right side (as viewed in FIG. 2) of the commodity storage chamber 3, and an air guiding duct 10*b*. As the air driven by the fan 11*b* circulates through the chamber sections 3*c*, 3*d* of the second group and the heater 11*a*, as indicated by arrow-pointed broken lines, the chamber sections 3*c*, 3*d* are warmed up by the heating system.

Still referring to FIG. 2, the removable lower divider panel 6*b* may also selectively be placed either between the chamber sections 3*a* and 3*b* or between the chamber sections 3*c* and 3*d*. If the lower divider panel 6*b* is placed between, for example, the chamber sections 3*a* and 3*b*, the left side commodity storage chamber will consist only of the chamber section 3*a* and will have an internal volume of about one third of that of the right side commodity chamber which will consist of the chamber sections 3*b*, 3*c* and 3*d*.

The dimensions of the upper divider panels 6*a*, the lower divider panel 6*b* and the perforations 100*p* of the guide plates 100 are properly determined so that the air flow between adjacent chamber sections is not substantially obstructed by the corresponding upper divider panel 6*a* or the guide plates 100 when the lower divider panel 6*b* is not present therebetween.

Figure 4A:
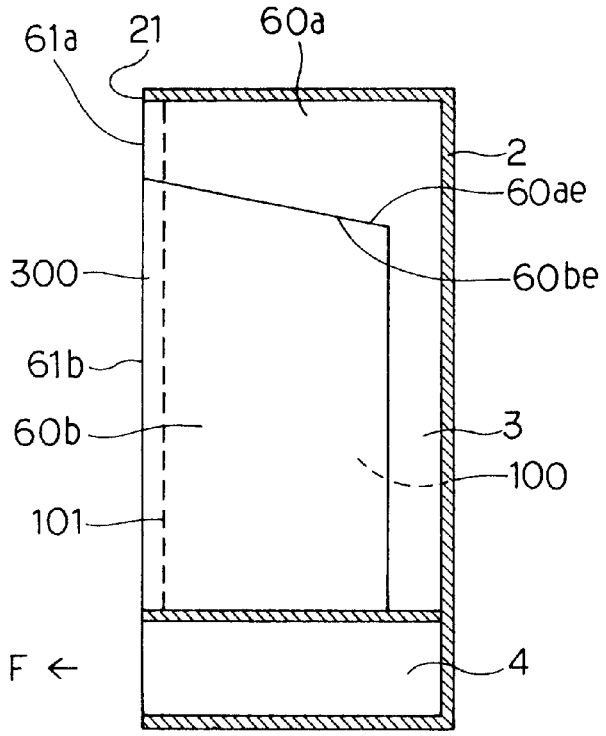
FIGS. 4(*a*) and 4(*b*) are side elevational sectional views particularly showing a housing, one of modified fixed divider panels, a modified removable divider panel and one of the guide plates used for the vending machine shown in FIG. 1 according to the second embodiment of the present invention.
Figure 4B:
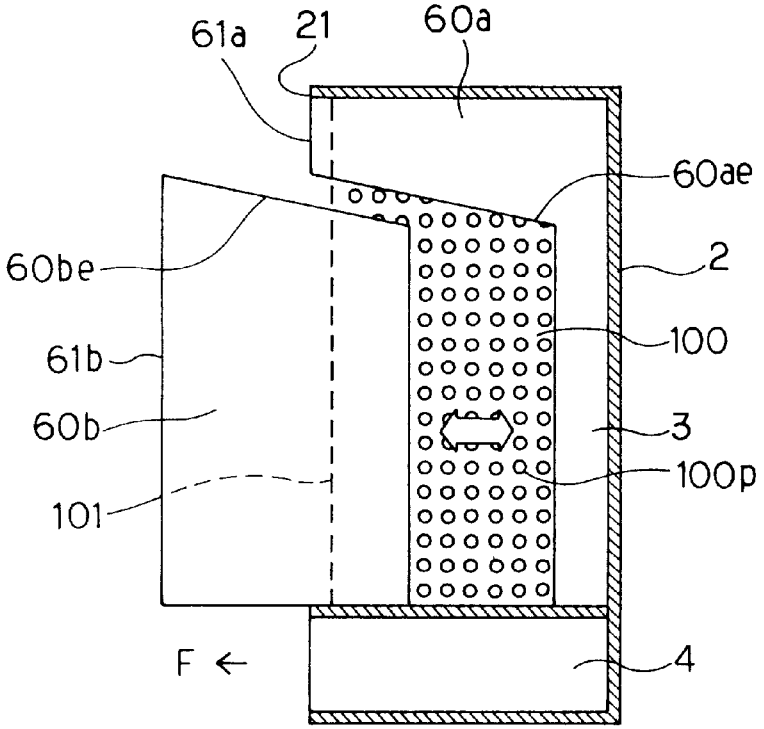

FIGS. 4(*a*) and 4(*b*) are side sectional elevational views particularly showing the housing 2 in section, one of modified fixed divider panels 60*a* and a modified removable divider panel 60*b* used for the vending machine according to the second embodiment of the present invention. Rear end part of each of the modified fixed divider panels 60*a* extends downwardly all the way to the bottom of the commodity storage chamber 3 and the depth of the modified removable divider panel 60*b* is smaller than the depth of the lower divider panel 6*b* of the first embodiment described above. All of the construction, functions, and features of the automatic vending machine according to the second embodiment, other than the fixed and the removable divider panels 60*a*, 60*b*, are exactly the same as those of the vending machine 1 described above. Like reference numerals or characters in FIGS. 3(*a*), 3(*b*), 4(*a*) and 4(*b*) denote like components or parts having like functions.

Each of the fixed divider panels 60*a* has an upper edge 60*ae* and the removable divider panel 60*b* has a top end edge 60*be*. The edges 60*ae* and 60*be* are adapted to abut each other, when the removable divider panel 60*b* is used in the commodity storage chamber 3, and both the edges 60*ae*, 60*be* are upwardly inclined toward the front (F) of the vending machine 1, as in the case of the edges 6*ae* and 6*be* shown in FIGS. 3(*a*) and 3(*b*).

Effects of the Present Invention

When the removable divider panel, having been once removed, is replaced into the commodity storage chamber, the removable divider panel must be inserted into the commodity storage chamber all the way in as shown in FIG. 3(*a*) or FIG. 4(*a*) so as not to leave any air flow opening between the selected chamber sections that are partitioned off from each other by the removable divider panel. While the removable divider panel is being inserted, the top end edge thereof will not touch the fixed divider panel, as shown in FIG. 3(*b*) or FIG. 4(*b*), because of the frontwardly upward inclination of the top end edge of the removable divider panel and the corresponding inclined part of the edge of the fixed divider panel. This not only makes possible a smooth friction-less insertion of the removable divider panel into the commodity storage chamber but also a substantial air tightness between the inclined edges since the inclined top end edge of the removable panel will be pressed against the corresponding inclined part of the edge of the fixed divider panel when the removable divider panel has been inserted all the way in. It goes without saying that little friction will be created between the inclined edges when the removable divider panel is pulled frontwardly so as to be removed from the commodity storage chamber. Furthermore, since only a part of the thermally-insulating panel, as opposed to the entirety of the panel as in the case of the above described prior art, which partitions off the adjacent chamber sections, is removed or reinserted, the removal or insertion work is substantially easy. In addition, since the removable panel can be held and stored on a front door of the vending machine, the removable panel being stored does not occupy any extra space on a side of the commodity storage chamber, thereby maintaining a desirable width of the vending machine, yet still having a desirable commodity storage space. Thus, the vending machine can easily be substituted for a regular vending machine having a standard width when the site where the vending machine is placed has a limited width or when the vending machine being removed for replacement is flanked on both sides by other vending machines.

It should also be understood that various changes and modifications may be made in the above described embodiments which provide the characteristics of the present invention without departing from the spirit and principle thereof particularly as defined in the following claims.

What is claimed is:

1. An automatic vending machine, comprising:

(a) a housing;

(b) a plurality of commodity storage chamber sections disposed in a side-by-side arrangement in said housing;

(c) a plurality of thermally-insulating first divider panels fixedly installed in said housing, each of said first divider panels being disposed between each pair of said chamber sections adjacent to each other in a manner that the adjacent chamber sections are still communicated with each other through an air channel therebetween; and (d) a removable thermally-insulating second divider panel that is adapted for being placed in said housing between a selected pair of said chamber sections adjacent to each other to block the air channel between said selected pair of adjacent chamber sections so that the communication between said selected pair of adjacent chamber sections is completely shut off by said removable second divider panel;

wherein said removable second divider panel has a top end edge and each of said fixed first divider panels has a first edge that is adapted for abutting said top end edge of said second divider panel.

2. An automatic vending machine according to claim 1, said vending machine further comprising:

(e) means for refrigerating a first group of said chamber sections; and (f) means for heating a second group of said chamber sections, wherein the communication between said first group of chamber sections and said second group of chamber sections is shut off by said removable second divider panel.

3. An automatic vending machine, comprising:

(a) a housing;

(b) a plurality of commodity storage chamber sections disposed in a side-by-side arrangement in said housing;

(c) a plurality of thermally-insulating first divider panels fixedly installed in said housing, each of said first divider panels being disposed between each pair of said chamber sections adjacent to each other in a manner that the adjacent chamber sections are still communicated with each other through an air channel therebetween; and (d) a removable thermally-insulating second divider panel that is adapted for being placed in said housing between a selected pair of said chamber sections adjacent to each other to block the air channel between said selected pair of adjacent chamber sections so that the communication between said selected pair of adjacent chamber sections is completely shut off by said removable second divider panel;

wherein said removable second divider panel has a top end edge and each of said fixed first divider panels has a first edge that is adapted for abutting said top end edge of said second divider panel, and said top end edge and said first edge are upwardly inclined toward the front of the vending machine when said second divider panel is placed in said housing to shut off the communication between said selected adjacent chamber sections.

4. An automatic vending machine, comprising:

(a) a housing;

(b) a plurality of commodity storage chamber sections disposed in a side-by-side arrangement in said housing;

(c) a plurality of thermally-insulating first divider panels fixedly installed in said housing, each of said first divider panels being disposed between each pair of said chamber sections adjacent to each other in a manner that the adjacent chamber sections are still communicated with each other through an air channel therebetween;

(d) a removable thermally-insulating second divider panel that is adapted for being placed in said housing between a selected pair of said chamber sections adjacent to each other to block the air channel between said selected pair of adjacent chamber sections so that the communication between said selected pair of adjacent chamber sections is completely shut off by said removable second divider panel; and (e) a front door, pivotably supported by said housing, having a holder for holding and storing said removable second divider panel.

5. An automatic vending machine according to claim 4, wherein said holder is adapted for holding said removable second divider panel in a manner that a front edge of said removable second divider panel is always at an angle with respect to a side edge of said door.

* * * * *